US006139452A

United States Patent [19]

McSherry et al.

[11] Patent Number: 6,139,452

[45] Date of Patent: Oct. 31, 2000

[54] PROJECTILE FOR TOSSING GAME AND ASSOCIATED METHOD OF PLAY

[76] Inventors: Patrick J McSherry; Beverly A McSherry; Shannon M McSherry, 30 W. Deep Dale Dr., all of Levittown, Pa. 19056; Robert Stucky, 113 Coach Rd., Langhorne, Pa. 19047

[21] Appl. No.: 09/287,887

[22] Filed: Apr. 7, 1999

[51] Int. Cl.[7] ..... A63B 65/00

[52] U.S. Cl. ..... 473/569

[58] Field of Search ..... 273/317; 473/569, 473/588, 590, 595; 446/34, 46

[56] References Cited

U.S. PATENT DOCUMENTS

| | | | |
|---|---|---|---|
| D. 219,822 | 2/1971 | Rockaitis | 473/569 X |
| 4,378,653 | 4/1983 | O'Brien | 446/46 |
| 4,555,114 | 11/1985 | Dozier | 473/588 |
| 5,078,639 | 1/1992 | Kippen | 446/34 X |
| 5,213,539 | 5/1993 | Adler | 473/590 X |
| 5,257,783 | 11/1993 | Callaghan | 473/588 X |
| 5,570,888 | 11/1996 | Robinson et al. | 473/588 X |

FOREIGN PATENT DOCUMENTS

| | | | |
|---|---|---|---|
| 90/09829 | 9/1990 | WIPO | 473/FOR 228 |

*Primary Examiner*—Raleigh W. Chiu
*Attorney, Agent, or Firm*—LaMorte & Associates P.C.

[57] ABSTRACT

A projectile device for use in a tossing game. The projectile has a body with a concave bottom surface and a convex top surface. The body can have any shape, but is preferably triangular, wherein three side edges define the convex top surface and the concave bottom surface. Regardless of the shape of the projectile's body, the body of the projectile has a geometrical center. However, the projectile is fabricated so that the body of the projectile has a center of gravity that does not correspond to the geometrical center of the body. As a result, if the projectile is tossed with a spinning motion, the projectile will not evenly rotate about its geometrical center. The combination of the shape of the projectile, the contours of the projectile and the off-center center of gravity for the projectile make the flight characteristics of the projectile difficult to anticipate. The unpredictability in flight characteristics is a desired novel feature in the tossing game for which the projectile is used.

16 Claims, 7 Drawing Sheets

PROJECTILE FOR TOSSING GAME AND ASSOCIATED METHOD OF PLAY

BACKGROUND OF THE INVENTION

1. Field of the Invention

The present invention relates to tossing games where a projectile is tossed by a player toward a target. More particularly, the present invention is related to the structure of the projectile and how that structure effects the flight characteristics of the projectile when tossed.

2. Description of the Prior Art

Over the years, countless people have improvised many different games and activities that can be played at the beach. Many of these games and activities use materials that are found naturally at the beach. For example, people commonly build sand castles with the sand available at the beach. Many other games and activities have been developed that are played with shells, stones, driftwood and other materials that are commonly found along an ocean beach.

In many different improvised games, seashells are used as projectiles and are tossed at a variety of improvised targets. Along the beaches of the north eastern portion of the United States, clam shells are one of the most common prevalent shells found. Clam shells are generally semicircular in shape and can have any length up to eight inches.

In nature, no two seashells are exactly the same. Rather, different shells have different shapes, different sizes, different surface textures and different centers of gravity. As a result, when tossed, no two seashells will fly through the air with the same aerodynamic characteristics. Consequently, when a game is improvised so that seashells are tossed at an object, often the person with the best seashells wins. The game therefore becomes a test of who has the best luck in finding seashells rather than a game of skill.

Even if players in an improvised shell tossing game have generally equivalent shells, that condition changes during the course of the game. If one shell is tossed and strikes another shell, one or both of the shells often break. As a result, the shells no longer have the same shape, mass, center of gravity or aerodynamic properties that they once had. Accordingly, the shells do not fly consistently during the course of the game. Furthermore, when shells are broken due to impact with another shell, shards of the shell break away. The shards often have pointed tips and sharpened edges. Since the game is being played on the beach, the players commonly have bare feet. The shards of broken shells therefore represent a physical danger to both the players and people who may walk across the beach when the game is over.

In a shell tossing game, the availability of shells and the size of the shells found effects the choice of targets used in the game. For instance, if players are tossing shells into a bucket with a five inch diameter open top, obviously shells with lengths longer than five inches would not be used because they would not fit into the target. Similarly, if a target was positioned far away from the tossing point and a strong wind was blowing across the beach, shells with a large mass would be much more preferable than would be lighter shells.

The variability in shell size, shape, flight characteristics and availability make it impractical to standardize any one shell tossing game or maintain statistical records for any one tossing game. Accordingly, shell tossing tournaments and competitions played on different days at different beaches would be problematic.

A need therefore exists for a way to standardize the tossing game so that the game can be consistently played regardless to the location of the beach or the availability of indigenous shells. This need is met by the present invention as described and claimed below.

SUMMARY OF THE INVENTION

The present invention is a projectile device for use in a tossing game. The projectile has a body with a concave bottom surface and a convex top surface. The body can have any shape, but is preferably triangular, wherein three side edges define the convex top surface and the concave bottom surface. Regardless of the shape of the projectile's body, the body of the projectile has a geometrical center. However, the projectile is fabricated so that the body of the projectile has a center of gravity that does not correspond to the geometrical center of the body. As a result, if the projectile is tossed with a spinning motion, the projectile will not evenly rotate about its geometrical center. The combination of the shape of the projectile, the contours of the projectile and the off-center center of gravity of the projectile make the flight characteristics of the projectile difficult to anticipate. The unpredictability in flight characteristics is a desired novel feature in the tossing game for which the projectile is used.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE INVENTION

In the prior art, one of the reasons shell tossing games are popular is because of the flight characteristics of a shell. A shell has different surfaces with different contours. When a shell is tossed, the aerodynamics of the shell constantly change as the shell spins in flight. Different players toss shells in different ways in order to create a more predictable flight path for the shell. Players may toss the shell with a slow spin or a quick spin. Alternatively, players may toss the shell so that it flips end-over-end.

The present invention is a projectile that is designed to mimic some of the unpredictable flight characteristics of a natural shell. However, the size of the present invention projectile can be made to a predetermined standard so that different players will be equally matched. Furthermore, the present invention projectile is made of a durable material that will not break when thrown against another projectile of some other hard surface. This eliminates the physical dangers associated with shards of shell that break away from natural shells.

Figure 1:
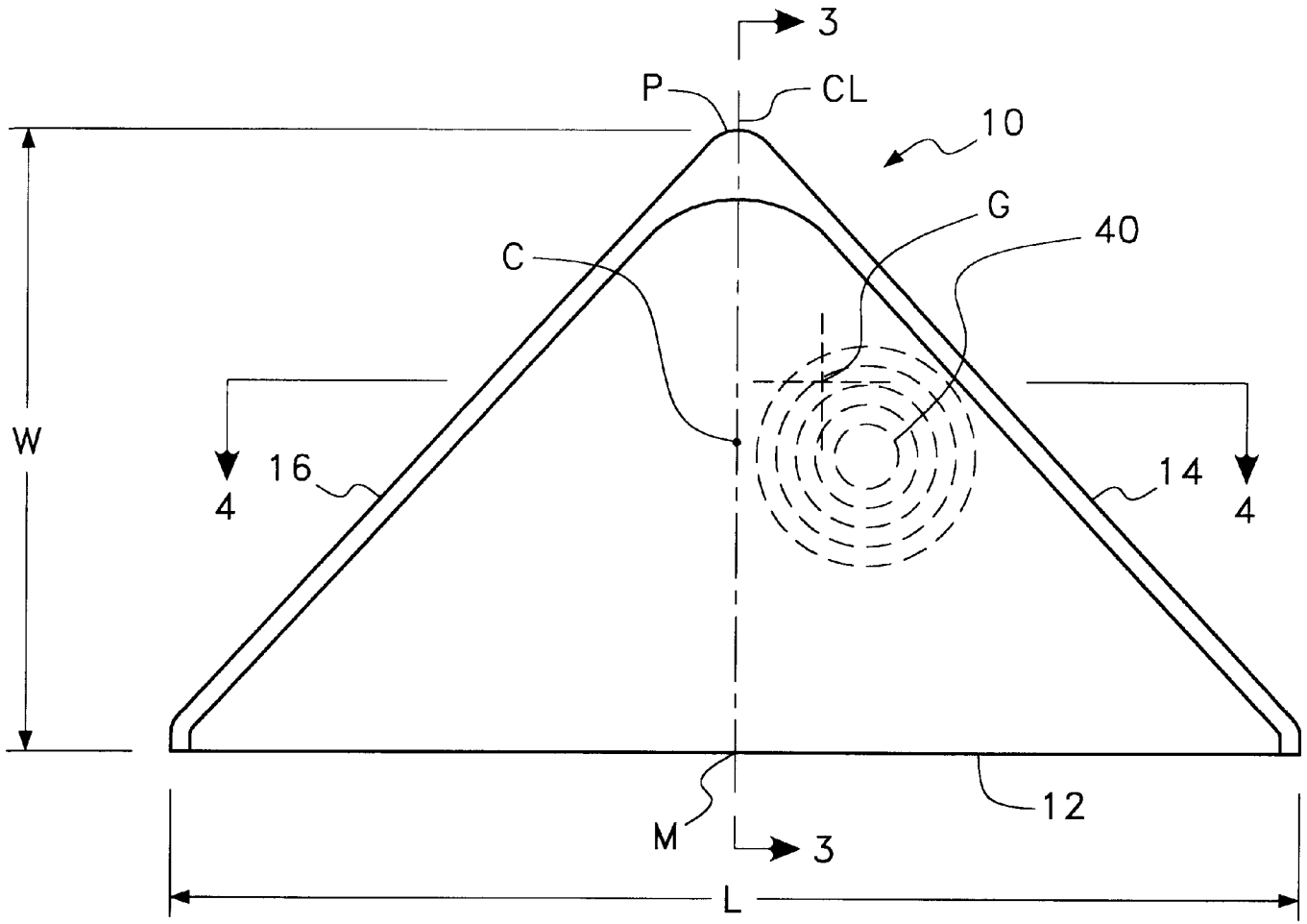
FIG. 1 is a bottom view of an exemplary embodiment of a projectile in accordance with the present invention.
Figure 2:
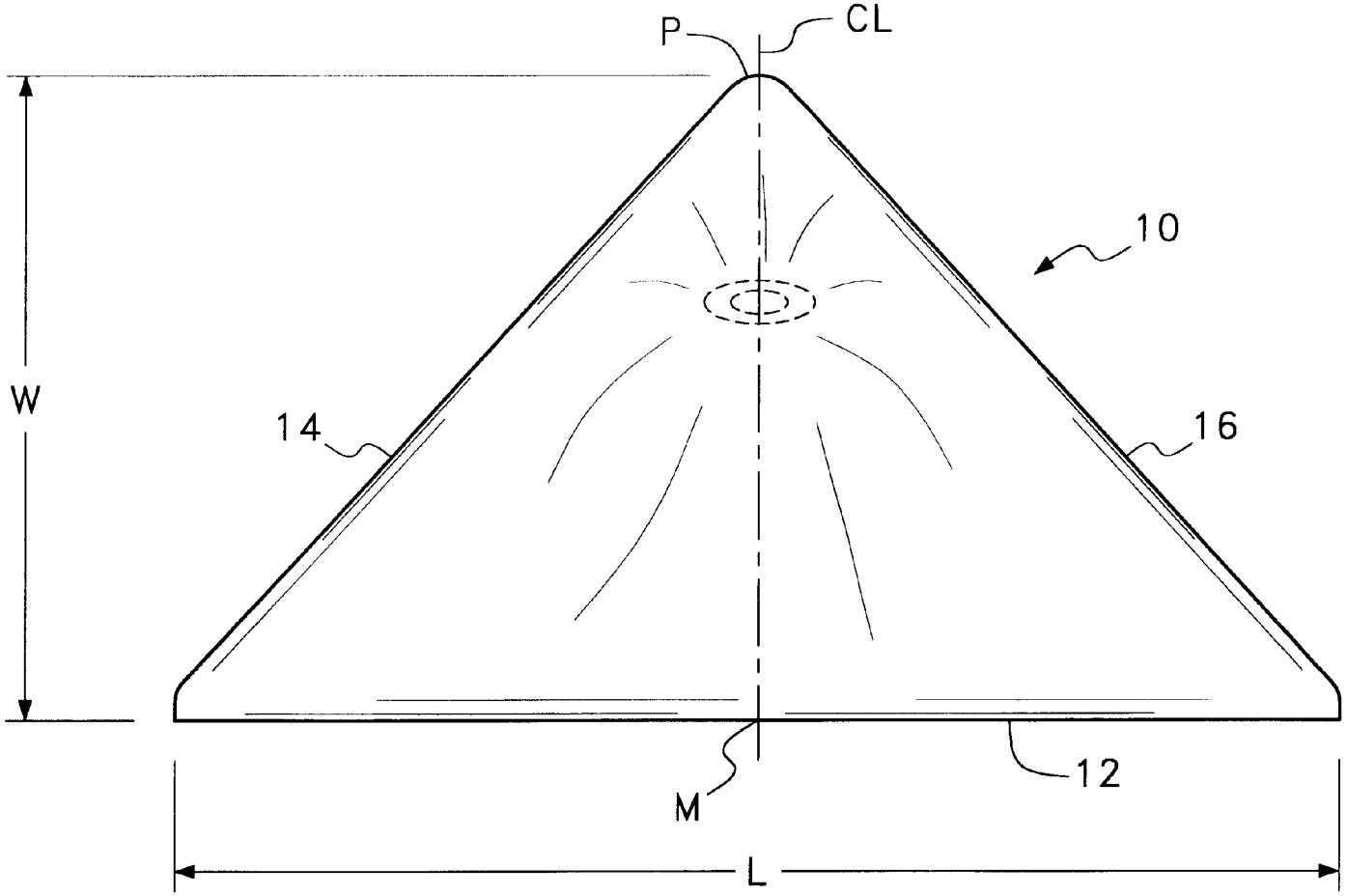
FIG. 2 is a top view of the exemplary embodiment shown in FIG. 1.

Referring to FIG. 1 and FIG. 2, a first exemplary embodiment of a projectile 10 in accordance with the present invention is illustrated. The projectile 10 is made of a non-brittle material such as plastic, metal, a cured resin or a composite material. The projectile 10 is preferably generally triangular in shape, having a long edge 12 and two shorter side edges 14, 16. The long edge 12 of the projectile 10 is the longest part of the projectile 10 having a maximum length L of between 2 inches and 10 inches. The widest part of the projectile 10 extends along the center line CL of the projectile 10. The center line CL is an imaginary line that extends from the midpoint M of the long edge 12 to the convergence point P of the two short edges 14, 16. The width W of the projectile 10 as measured along the center line CL is preferably between 2 inches and 8 inches. Depending upon the material used to fabricate the projectile 10, the projectile 10 preferably has a weight of between 2 ounces and 16 ounces.

Figure 3:
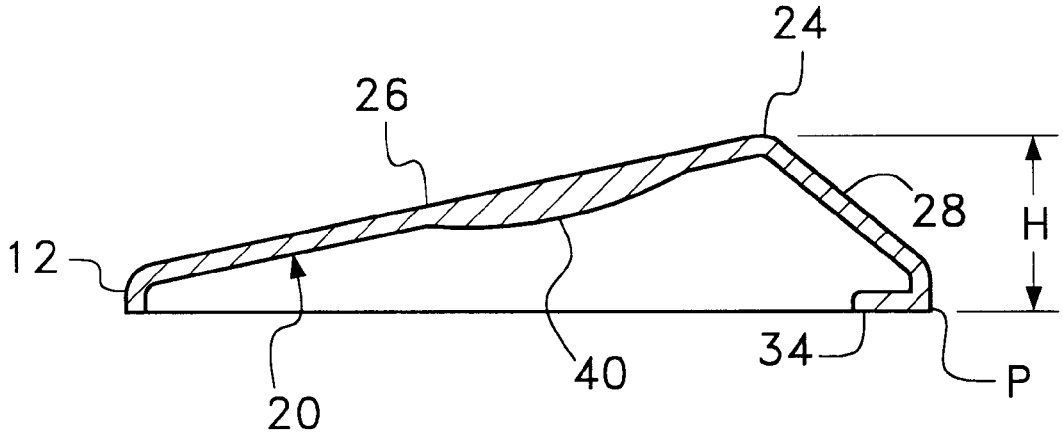
FIG. 3 is a cross-sectional view of the embodiment of FIG. 1 viewed along section line 3—3.
Figure 4:
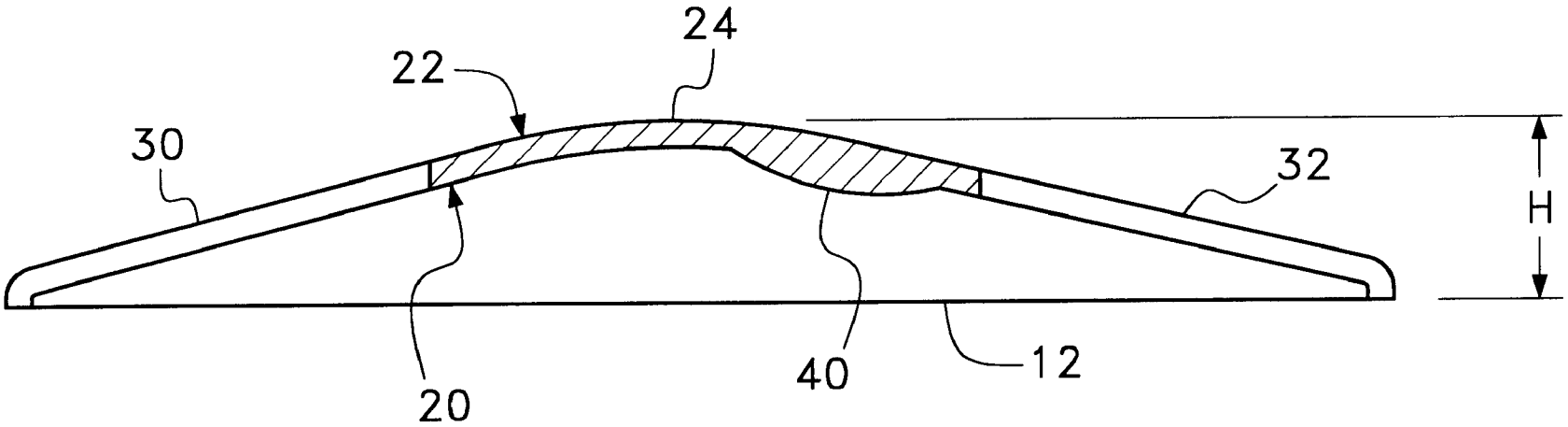
FIG. 4 is a cross-sectional view of the embodiment of FIG. 1 viewed along section line 4—4.

Referring to FIG. 3 and FIG. 4, it can be seen that projectile 10 has a generally domed shape that defines and inclosed space. As a result, the bottom surface 20 of the projectile 10 is generally concave and the top surface 22 of the projectile 10 is generally convex. The base of the projectile 10 terminates in a common plane. The highest point of the projectile extends a height H above the base plane, wherein the height H is preferably between ¼ inch and 3 inches. The highest point of the projectile is the apex 24. The apex 24 lays upon the center line CL (FIG. 1) at some point in between the base edge 12 and the convergence point P of the side edges 14, 16. All the surfaces of the projectile slope upwardly from the base plane to the apex 24. Consequently, the projectile 10 has a positively sloped front surface 26 (FIG. 3), a negatively sloped back surface 28 (FIG. 3), a positively sloped left side surface 30 (FIG. 4) and a negatively sloped right side surface 32 (FIG. 4).

The edges of the projectile 10 generally terminate along in a common base plane. However, in the area proximate the point of convergence P of the side edges, the edge of the projectile 10 is turned under to produce a hooked lip 34 (FIG. 3). The hooked lip 34 is useful in grasping the projectile 10 and tossing the projectile 10 end-over-end.

Referring to FIG. 2, FIG, 3 and FIG. 4, it can be seen that an area of increased mass 40 is disposed in one side of the center line CL at a point between the long edge 12 and the convergence point P of the side edges 14, 16. The purpose of the area of increased mass 40 is to move the center of gravity G of the projectile 10 to a point that is not in the geometrical center C of the object. As a result, if the projectile 10 is tossed with a spinning motion, the projectile 10 will not rotate evenly around its geometrical center C.

Figure 5:
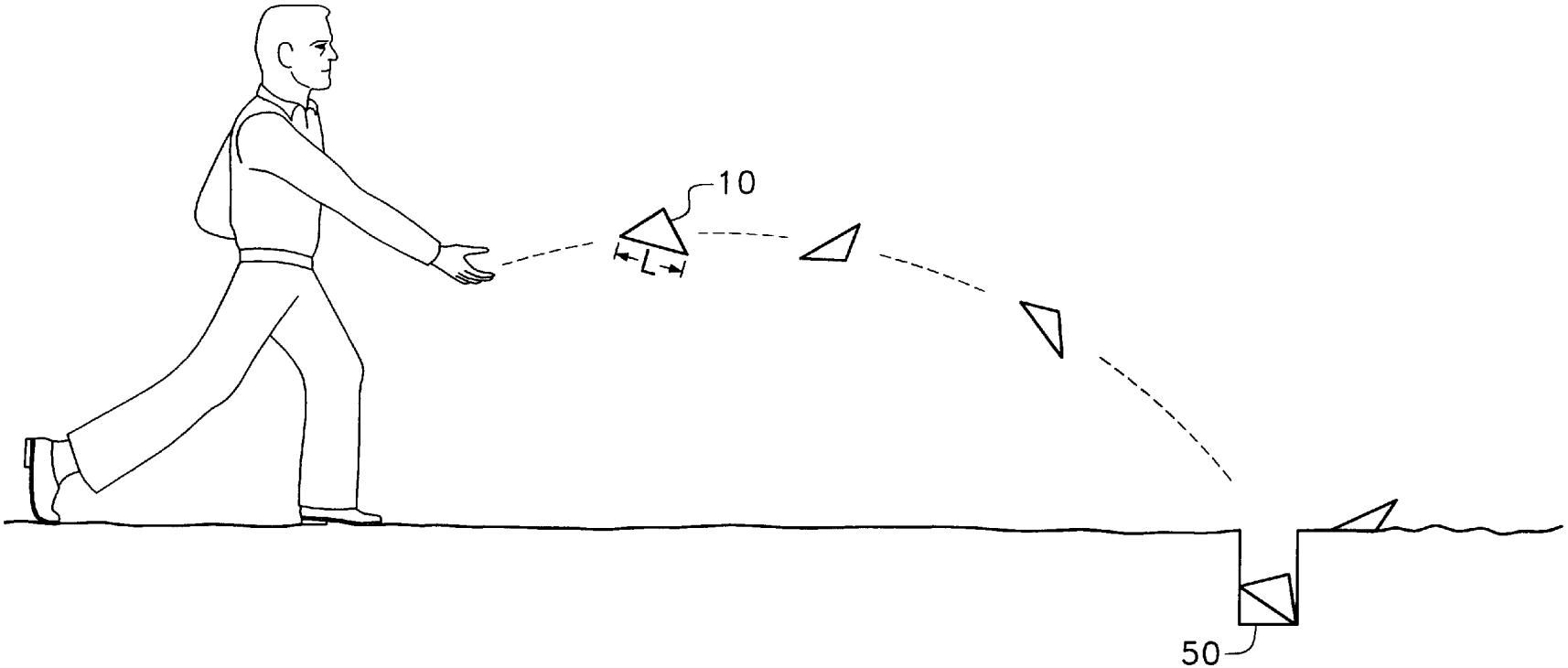
FIG. 5 illustrates a preferred method of play utilizing the projectiles of the present invention.

Referring to FIG. 5, the purpose of the projectiles 10 and a method of play can be described. To ready the game for play at least one hole 50 is dug in the ground a predetermined distance from a throwing point. The hole 50 is preferably round, having a diameter that is between 25% and 100% larger than the maximum length L of the projectile. The distance between the throwing point and the target hole 50 is preferably at least 10 feet but can be between 5 feet and 25 feet depending upon the size and mass of the selected projectile and weather conditions. Players take turns tossing the projectiles 10 toward the target hole 50. Players that toss the projectile 10 into the hole 50 receive points. The number of tosses and the point amounts awarded for each successful toss can of course be varied by the players.

The projectile 10 can be tossed in any manner preferred by the players. The triangular, convex/concave shape of the projectile 10 helps it catch the air and float like a disk when thrown with a rotating motion. However, due to the center of gravity of the projectile 10 not being in the geometrical center of the projectile 10, any toss of the projectile 10 with a rotating motion will cause the projectile 10 to spin in an uneven manner and therefore fly in an unpredictable manner. Alternatively, a person can toss the projectile 10 by flipping it end-over-end. The hook lip 34 (FIG. 3) helps a person hold the projectile 10 and toss it end-over-end. If the projectile 10 is tossed end-over-end, the concave and convex surfaces of the projectile will alternately face the oncoming wind. The unsymeterical shape of these surfaces will also cause the projectile 10 to fly in an unpredictable manner.

Regardless of how the projectile 10 is tossed, each projectile is identical. As a result, any two projectiles 10 thrown in the same manner and under the same conditions should perform in the same manner. This enables players to develop tossing skills for different conditions, whereby the better skilled player will win the game. This differs greatly from the prior art where the player with the best projectiles and the best luck typically won the game.

Figure 6:
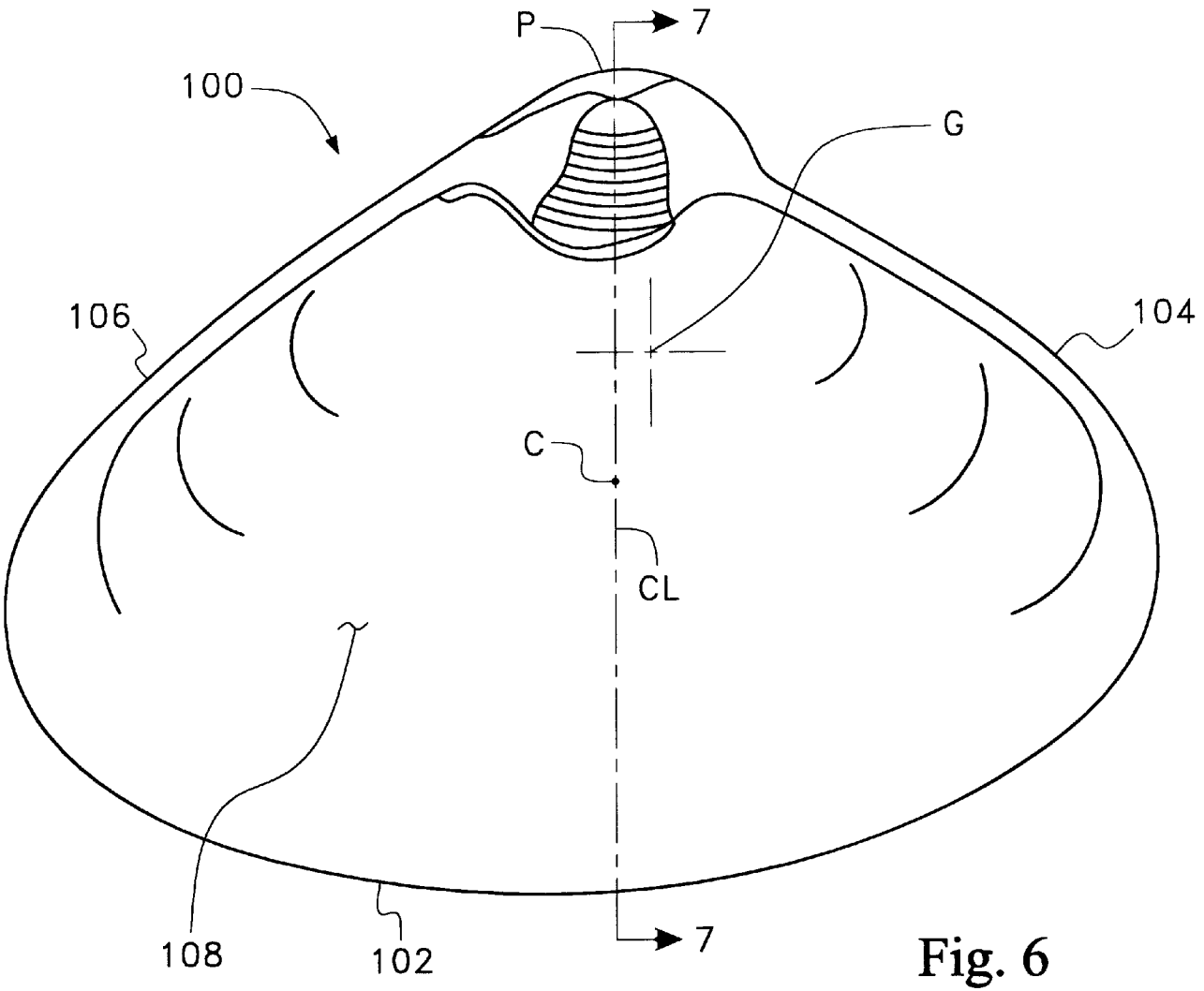
FIG. 6 is a bottom view of an alternate embodiment of a projectile in accordance with the present invention.
Figure 7:
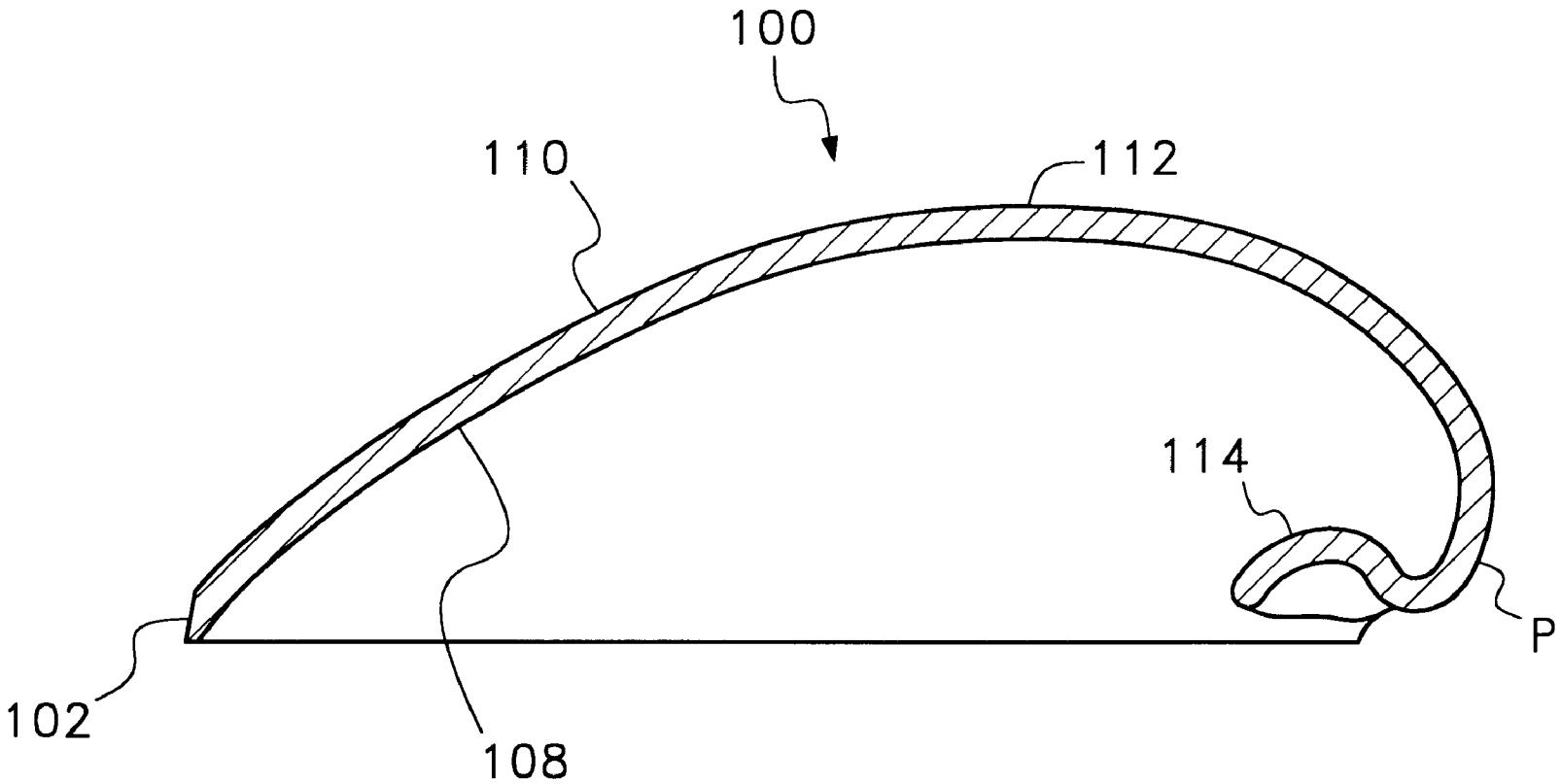
FIG. 7 is a cross-sectional view of the embodiment of FIG. 6 viewed along section line 7—7.

Referring to FIG. 6 and FIG. 7, an alternate exemplary embodiment of a projectile 100 is shown in accordance with the present invention. In this embodiment the projectile 100 is formed to superficially have the appearance of one half of a clam shell. However, the novel features shared with the initial embodiment are still present. For instance, it can be seen that the bottom of the projectile terminates in a common plane. The projectile 100 itself is generally triangular in shape having a long edge 102 and two shorter side edges 104, 106. The bottom surface 108 of the projectile 100 is concave, while the top surface 110 of the projectile 100 is convex. The top surface 110 of the projectile 100 has an apex point 112, wherein all of the surfaces on the top of the projectile 100 slop toward the apex point 112. The apex point 112 is positioned on an imaginary center line CL that extends from the middle of the long edge 102 to the point of convergence P between the two side edges 104, 106.

The area of the projectile 100 proximate the point of convergence P between the side edges is hooked under to create a small lip 114. The lip 114 enables a player to easily grip the projectile 100 and throw it end-over-end. Referring solely to FIG. 6, it can be seen that the projectile 100 is not formed symmetrically. As a result, the center of gravity G for the projectile 100 does not fall on the imaginary center line CL. As a result, if the projectile 100 is tossed with a spinning motion, the projectile 100 will not rotate evenly around its geometrical center C. The triangular, convex/concave shape of the projectile 100 helps it catch the air and float like a disk when thrown with a rotating motion. However, due to the center of gravity G of the projectile 100 not being in the geometrical center C of the projectile 100, any toss of the projectile 100 with a rotating motion will cause the projectile 100 to spin in an uneven manner and therefore fly in an unpredictable manner. Alternatively, a person can toss the projectile 100 by flipping it end-over-end. The hook lip 114 (FIG. 7) helps a person hold the projectile 100 and toss it end-over-end. If the projectile 100 is tossed end-over-end, the concave and convex surfaces of the projectile 100 will alternately face the oncoming wind, wherein both surface act differently with respect to aerodynamics. The unsymeterical shape of these surfaces will also cause the projectile to fly in an unpredictable manner.

It will be understood that the various figures described above illustrate only two preferred embodiments of the present invention. A person skilled in the art can therefore make numerous alterations and modifications to the shown embodiment utilizing functionally equivalent components to those shown and described. All such modifications are intended to be included within the scope of the present invention as defined by the appended claims.

What is claimed is:

1. A projectile device for use in a tossing game, comprising:

a body having a concave bottom surface, a convex top surface, a geometrical center and a center of gravity located at a point other than said geometrical center, wherein said body is made from a non-brittle material selected from a group consisting of metal, plastic, resin-based and composite materials.

2. The device according to claim 1, wherein body is generally triangular in shape and said convex top surface and said concave bottom surface share a common long edge and two side edges.

3. The device according to claim 1, wherein said side edges meet at a convergence point and said geometrical center lays on an imaginary line that extends from said convergence point to a midpoint of said long edge.

4. The device according to claim 3, wherein said convex top surface has an apex point that lays on said imaginary line between said convergence point and said long edge, wherein all surfaces on said convex top surface slope toward said apex point.

5. The device according to claim 3 wherein a lip is disposed on said bottom surface proximate said convergence point.

6. The device according to claim 1, wherein said body is configured to mimic the appearance of a seashell.

7. A projectile device for use in a tossing game, comprising;

a generally triangular body having three edges;

a convex top surface disposed between said three edges; and a concave bottom surface disposed between said three edges, wherein said body is made from a material selected from a group consisting of metal, plastic, resin-based and composite materials, and said body has a geometrical center and a center of gravity that does not correspond in position with said geometrical center.

8. The device according to claim 7, wherein said three edges includes a base edge and two side edges, wherein said side edges meet at a convergence point and said geometrical center lays on an imaginary line that extends from said convergence point to a midpoint of said base edge.

9. The device according to claim 8, wherein said convex top surface has an apex point that lays on said imaginary line between said convergence point and said base edge, wherein all surfaces on said convex top surface slope toward said apex point.

10. The device according to claim 8, wherein a lip is disposed on said bottom surface proximate said convergence point.

11. The device according to claim 8, wherein said base edge is longer than either of said side edges.

12. The device according to claim 8, wherein said base edge is between 2 inches and 10 inches in length.

13. The device according to claim 12 wherein said body has a width of between 2 inches and 8 inches.

14. The device according to claim 9 wherein said body has a height at said apex point of between ¼ inch and three inches.

15. The device according to claim 14 wherein said body has a mass of between 2 ounces and 16 ounces.

16. The device according to claim 7, wherein said body is configured to mimic the appearance of a seashell.

* * * * *